US007631447B2

(12) United States Patent
Morton et al.

(10) Patent No.: US 7,631,447 B2
(45) Date of Patent: Dec. 15, 2009

(54) DAMAGE RESISTANT MARKING STAKE

(76) Inventors: Scott A. Morton, 717 S. 2nd St., Laramie, WY (US) 82070; Naomi Morton Knight, 717 S. 2nd St., Laramie, WY (US) 82070; Craig Knight, 717 S. 2nd St., Laramie, WY (US) 82070

( * ) Notice: Subject to any disclaimer, the term of this patent is extended or adjusted under 35 U.S.C. 154(b) by 443 days.

(21) Appl. No.: 11/157,682

(22) Filed: Jun. 21, 2005

(65) Prior Publication Data

US 2006/0162207 A1 Jul. 27, 2006

Related U.S. Application Data

(60) Provisional application No. 60/647,527, filed on Jan. 27, 2005.

(51) Int. Cl.
*G09F 15/00* (2006.01)

(52) U.S. Cl. ..... 40/607.05; 52/103; 52/165; 116/209

(58) Field of Classification Search ..... 40/607.05; 248/156; 116/209, 173; 52/103, 104, 165; 411/179, 301, 414
See application file for complete search history.

(56) References Cited

U.S. PATENT DOCUMENTS

| | | | | | |
|---|---|---|---|---|---|
| 3,279,133 | A * | 10/1966 | De Korte | 52/103 |
| 3,300,918 | A * | 1/1967 | Maule | 52/103 |
| 3,371,647 | A * | 3/1968 | Shopbell | 116/209 |
| 4,185,424 | A * | 1/1980 | Streit | 52/103 |
| 4,433,490 | A | 2/1984 | Black | |
| 4,702,639 | A | 10/1987 | Hinterholzer | |
| 4,852,512 | A | 8/1989 | Klatt | |
| 4,862,823 | A | 9/1989 | Hughes | |
| 4,926,785 | A * | 5/1990 | Lamson | 116/209 |
| 5,040,478 | A * | 8/1991 | Hughes | 116/209 |
| 5,186,119 | A * | 2/1993 | Hlavin | 116/222 |
| 5,247,900 | A | 9/1993 | Sobczak | |
| 5,357,897 | A * | 10/1994 | Bailey | 116/209 |
| 5,825,298 | A * | 10/1998 | Walter | 340/825.49 |
| 6,085,452 | A * | 7/2000 | Davis | 40/607.03 |
| 6,202,315 | B1 * | 3/2001 | Schmick, Jr. | 33/290 |
| 7,249,910 | B2 * | 7/2007 | Eckert et al. | 404/10 |
| 2005/0098087 | A1 * | 5/2005 | Carroll | 116/209 |

* cited by examiner

*Primary Examiner*—William L. Miller
(74) *Attorney, Agent, or Firm*—Stephen M. Nipper; Dykas, Shaver & Nipper, LLP

(57) ABSTRACT

A device for marking a location. The device coming in two separate pieces, namely a ground stake and a marking post. The ground stake configured for insertion into a ground surface. The marking post configured for attachment to the ground stake. The post is preferably removable from the stake so that when livestock are present, if they uproot or displace the marking post portion of the device, the ground stake remains in the ground still marking the location. If a survey crew or other individual is at the marking location after the post has been removed, they can replace the post (or insert a replacement post) to return the device to its full functionality.

12 Claims, 2 Drawing Sheets

DAMAGE RESISTANT MARKING STAKE

PRIORITY

This application is a non-provisional application which claims the priority date from the provisional application entitled FlexStayK Two-Piece Damage Resistant Marking Stake filed by Scott A. Morton, Naomi Morton-Knight and Craig Knight on Jan. 27, 2005 with application Ser. No. 60/647,527, the disclosure of which is incorporated herein by reference.

BACKGROUND OF THE INVENTION

1. Field of the Invention

The present invention generally relates to an improved marking stake and more particularly, to a two-piece damage resistant marking stake for effectively marking a location even when damaged or partially removed from the ground.

2. Background Information

Wooden stakes ranging from 12 inches to 48 inches in length are currently used in the majority of survey and location marking applications. Some plastic stakes are available as a direct replacement for wooden stakes. The higher cost of the plastic stakes frequently prevents or limits their use. Surveys for roads, pipelines and other such facilities are frequently carried out in harsh environments with considerable effort taken to effectively mark a position. In order to be effective, the stakes must remain positioned so that the marked position and attached information may be referenced in subsequent activities.

In many cases, surveying activities are done in areas where livestock is present or where other activities are taking place. Animals such as cows and horses frequently uproot or displace the stakes by chewing on, stepping on or rubbing on them. This problem is particularly acute in areas where cattle are present. Because cattle are used to contact and interaction with humans, they regularly follow behind a survey crew, breaking and/or pulling up survey stakes almost as soon as they are placed. The cattle chew on marking stakes and ribbons, pull them from the ground and rub on the stakes, thereby breaking them and/or obliterating the survey marking. In some cases, the stakes may simply be trampled resulting in the location sensitive marker being moved, broken or otherwise rendered unreadable. When stakes, ribbons, or other markers are broken, the survey staking must be repeated multiple times for a single project, incurring considerable additional expense.

There is a need in the art for a marking stake that will continue to mark a location despite being abused, broken, displaced, removed, or otherwise damaged as described above.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

One embodiment of the present invention is a device for marking a location. The device coming in two separate pieces, namely a ground stake and a marking post. The ground stake configured for insertion into a ground surface.

The marking post configured for attachment to the ground stake. The post is preferably removable from the stake so that when livestock are present, if they uproot or displace the marking post portion of the device, the ground stake remains in the ground still marking the location. If a survey crew or other individual is at the marking location after the post has been removed, they can replace the post (or insert a replacement post) to return the device to its full functionality.

The preferred ground stake having an abutment collar configured for abutting the ground surface, the abutment collar configured for allowing the stake to be driven into the ground surface but remaining clearly visible. The abutment collar further having a planar surface with a hole defined there through, this hole aligned with an internal passageway into a connection body. It is preferred that that abutment collar's upper facing surface have at least one planar writing surface for allowing marking information and data to be written thereupon.

The connection body having an open end (cooperating with the hole) extending to a closed end thereby defining a passageway there-between. Within the passageway is preferably a plurality of protrusions/flanges/tabs/teeth/ridges/etc., configured for grasping the marking post (when inserted therein). It is further preferred that at least one orifice extending from the passageway to an exterior surface of the body for allowing air to escape from the passageway when a first end of a post is inserted into the passageway be provided.

The ground stake further comprising a ground engagement portion connecting to one or both of the abutment collar/connection body. This ground engagement portion comprising at least one pointed distal end for insertion into a ground surface. Preferably, the ground engagement portion comprises at least one retaining ridge extending there-from for fixing the ground engagement portion within the ground surface.

The marking post having a first end extending to a second end. The first end configured for insertion into the passageway through the passageway open end and the hole in the abutment collar. It is preferred that the post has an exterior surface configured for being grasped by the passageway's interior protrusions. It is also preferred that the post have at least one planar writing surface for allowing marking information and data to be written thereupon.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein we have shown and described only the preferred embodiment of the invention, simply by way of illustration of the best mode contemplated by carrying out our invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
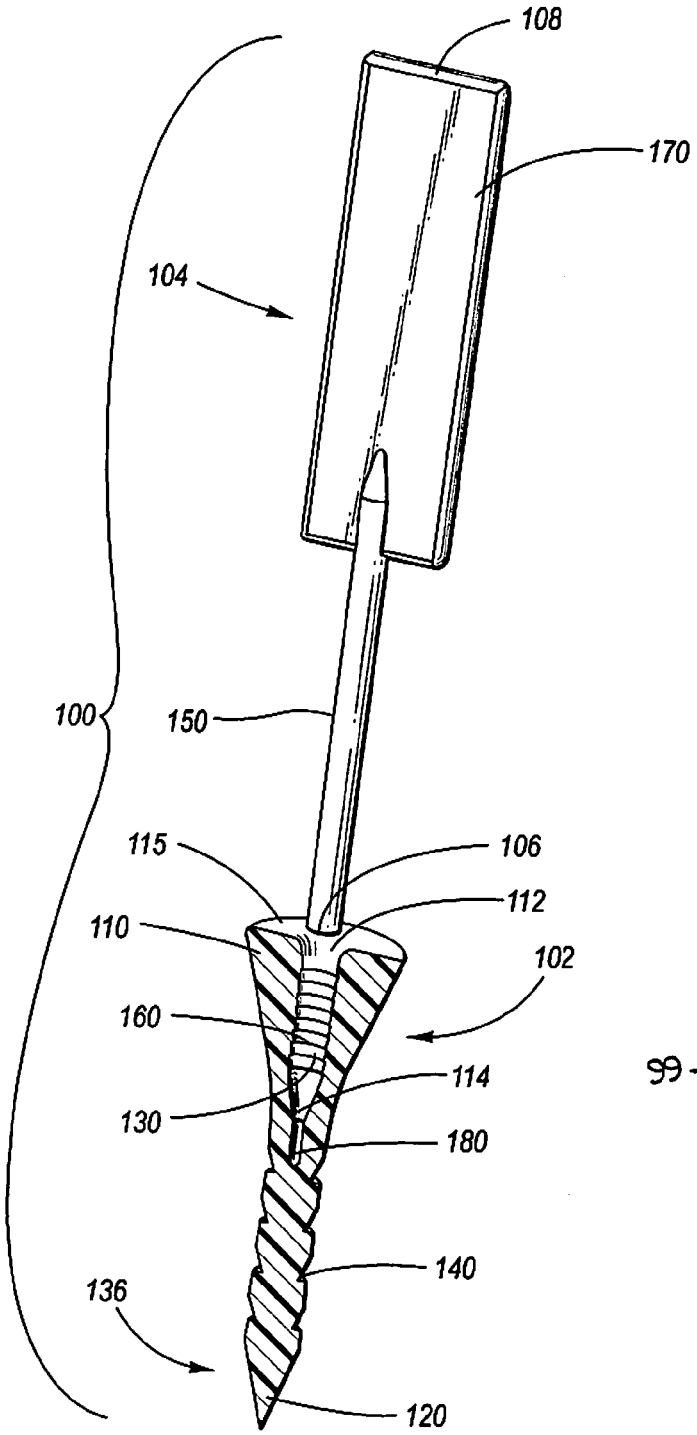
FIG. 1 is an exploded, perspective (partial cut-away) view of one embodiment of the present invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention relates to an improved marking device (marking stake) and more particularly, to a two-piece damage resistant marking stake for marking a location despite damage or partial removal from the ground. The present invention allows for a location to be effectively marked despite damage or removal as described above.

Figure 2:
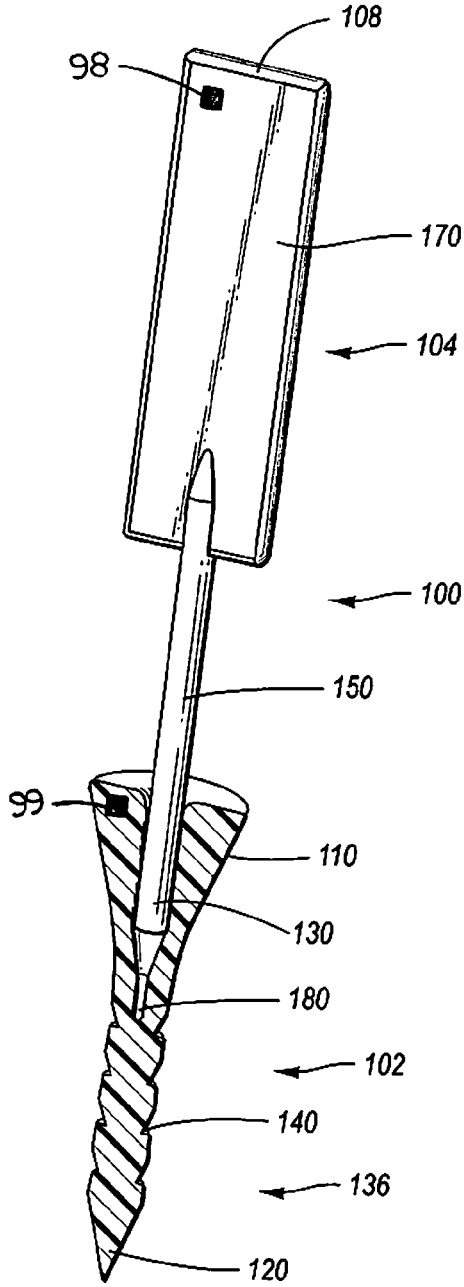
FIG. 2 is an un-exploded, perspective (partial cut-away) view of the embodiment of FIG. 1.
Figure 3:
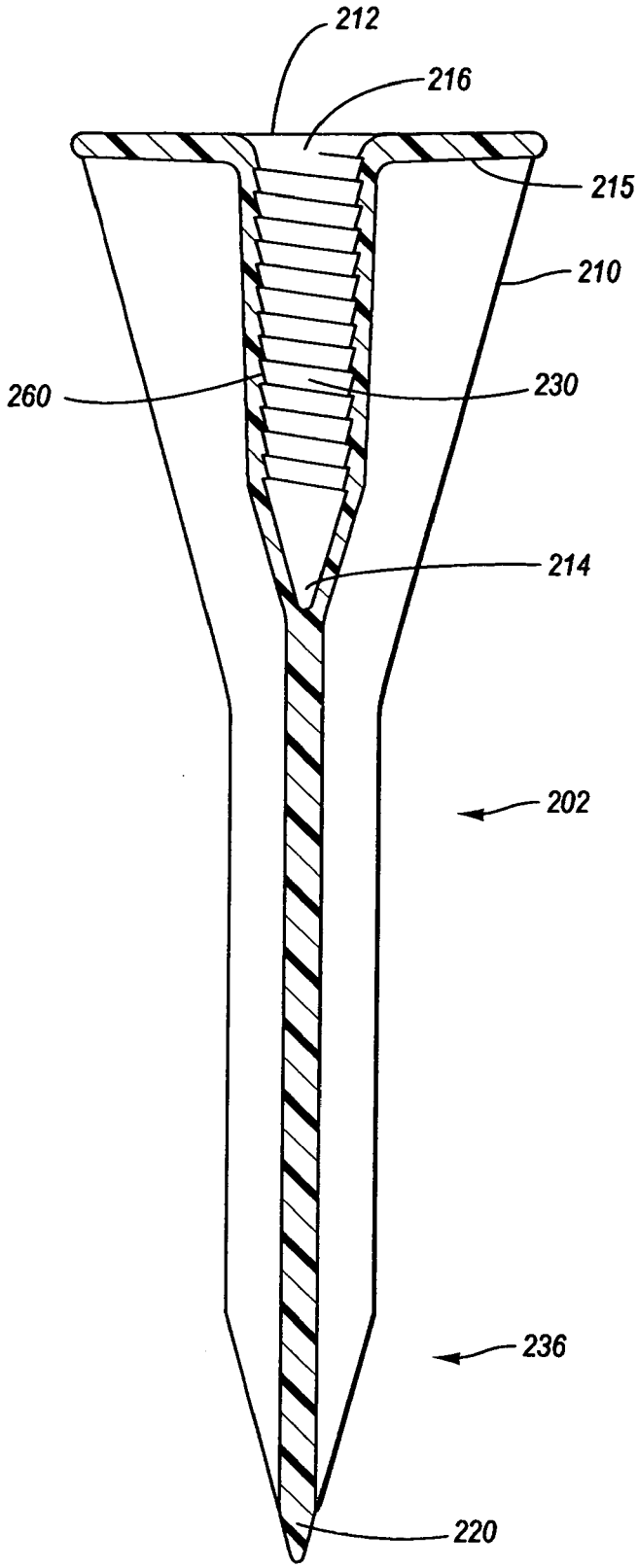
FIG. 3 is a cross-sectional view of a second embodiment of a ground stake/socket of the present invention.

FIGS. 1 and 2 show cut-away views of a first embodiment of the present invention (marking stake 100). FIG. 1 showing an exploded state, whereas FIG. 2 shows an unexploded (in-use) state. In the preferred embodiment, the present invention comprises these two main components: the ground stake ("ground socket") 102 and the marking post ("elastomeric shaft") 104. FIG. 3 shows a cross-sectional view of a second embodiment of a ground stake 202 of the present invention.

The first component of the present invention 100 is the ground stake 102. The ground stake 102 having a ground engaging portion 136 configured for being driven into the ground until (preferably) the abutment collar (top flange) 115 is generally flush with the ground surface. Being flush with the ground surface, the flange 115 visually demarks the location of the ground stake 102 attached there-to. Additionally, because the flange 115 is generally flush with the ground it is not easily removed by an animal, the elements and/or passing machinery. Because the diameter or shape of the flange 115 is larger than the diameter or shape of the ground engagement portion extending there below, the flange 115 prevents the ground stake 102 from being driven into the ground so far that it is no longer visible.

The ground stake 102 would most likely be molded of an impact resistance plastic material such as acrylonitrile-butadiene-styrene copolomers (ABS) or a polycarbonate/ABS alloy and would be colored a fluorescent orange, yellow, blue, red, etc., color similar to current survey marking paint and flagging. While these are the preferred materials of manufacture, obviously other materials would likewise be suitable.

The ground stake 102 has an upper portion connecting to the aforementioned flange 115. A pointed distal end (tip) 120 is provided at an end opposite the flange 115 of the ground stake 102. The tip 120 is formed and/or shaped to a point to more easily allow the ground stake 102 to be inserted, screwed, vibrated, pressed and/or driven into the ground.

The ground stake 102 having a connection body 110 configured for connecting with the marking post 104. The outer surface of the ground stake may be smooth (as shown in FIG. 3) if soil friction conditions are sufficient to resist extraction by livestock, or may define ground retaining ridges 140 (as shown in FIGS. 1 and 2) for preventing the ground stake 102 from being easily removed once inserted into the ground. The ground retaining ridges 140 are preferably one-way ridges or notches so that it is not difficult to pound, drive or otherwise insert the socket into the ground. Other such mechanisms known in the prior art could likewise be used to accomplish this same purpose including but not limited to threading, ring shanks, etc.

Installation of the ground stake 102 (insertion into the ground) may be accomplished in various manners. One installation method allows a special slide hammer designed with a pin to fit into a passageway ("socket cavity") 130 defined within the connection body 110. The passageway 130 having an internal passageway open end 112 and an internal passageway closed end 114. Hammering this slide hammer resulting in the ground stake 102 being driven into the ground. When the desired depth is reached, the pin would thus be removed from the passageway. The ground stake 102 may also be inserted by manually pushing it into the ground or by hammering the flange end of the ground stake 102.

In the preferred embodiment of the present invention, the flange 115 of the ground stake 102 is preferably large enough in shape/diameter to legibly write generally used survey marking information/data upon, for instance upon a planar surface 112.

Other manners of applying such data could likewise be provided, from stickers, to stamps, to RFID, etc. In one example, the top surface of the flange itself comprises a planar writing surface upon which a user could write using a permanent marker. The benefit of doing so is that if the marking post (which traditionally is the location of such data) is ever removed from the ground stake, data marked upon the planar writing surface allows a subsequent user to obtain useful marking information from the ground stake 102 itself.

The second component of the present invention 100 is the marking post 104. The marking post having a first end 106 and a second end 108. The marking post having an elastomeric shaft 150 that is configured for insertion into the socket cavity 130 of the ground stake 102. The shaft 150 is preferably flexible so that it will not break if driven over, stepped on, or in the event of other abuse. The shaft 150 would most likely be molded from polyurethane or polypropylene with a durometer A rating in the 80 to 95 range.

The socket cavity ("passageway") 130 of the ground stake 102 is preferably cylindrically shaped or tapered for allowing for increasing tightness as the shaft 150 is inserted further within the socket cavity 130. The ground stake 102 preferably further defines one-way retaining ridges (or other protrusions, flanges, etc) 160, 260 within the socket cavity 130 that grasps the shaft and thus prevent the shaft 150 from being easily extracted once inserted. These retaining ridges 260 may take the form of a tapered buttress screw thread as shown in FIG. 3 to facilitate removal of the molding core for the socket and to allow adjustment of the removal pull-out force for the elastomeric shaft 150 by how far the shaft 150 is screwed into the socket threads, may take the form of concentric ridges 160 as shown in FIGS. 1-2, etc.

Threaded retaining ridges 260 effectively allow a user to select a shaft 150 removal force by screwing the shaft against the retaining ridges 260 based on elements such as soil quality, animals present, and other environmental and external conditions. In the embodiment shown in FIGS. 1 and 2, the one-way retaining ridges 160 are ribbed ridges defining the edges of the socket cavity 130. Other types of connections are likewise envisioned.

The ground stake 102 may also define one or more slits 180 that extend from the socket cavity 130 to the outer surface of the ground stake 102. This allows air within the socket cavity 130 to be displaced to outside the ground stake 102 so that air is not compressed within the ground stake 102 creating a rebounding force that would tend to push the shaft 150 out of the ground stake 102 as a user inserts the shaft into the socket. Additionally, this allows the outer surface area of the ground stake 102 and the shaft 150 to be more closely matched creating a much tighter fit. The elastomeric shaft 150 may also be tapered to match the taper of the tapered buttress screw threads of the retaining ridges 160 in the socket allowing for a much tighter fit when a user determines that conditions warrant. The marking post 104 is preferably installed by pushing the end of the shaft 150 into the passageway 130 by hand and turning the shaft to engage the buttress screw thread retaining ridges.

The elastomeric shaft 150 preferably comprises or connects with a planar writing surface 170. In the embodiment shown in FIGS. 1 and 2, this writing surface being a paddle. The paddle having a flat shaped writing area or planar surface on which survey marking information may be written. In one embodiment, the entire elastomeric shaft 150 would be molded from the same fluorescent orange, yellow, blue, red, etc., colors as the ground stake 102. Different colors of shafts 150 and sockets 110 could be mixed and matched for specific applications as decided by a user.

In the preferred embodiment, the extraction force needed to remove the shaft 150 of the marking post 104 from the ground stake 102 is preferably less than the extraction force of the ground stake 102 from the ground, so that if the shaft 150 is removed, the ground stake 102 remains in the ground to mark the survey point. It is preferred that the ground stake 102 be brightly colored to allow the ground stake 102 to be more easily located if the elastomeric shaft 150 is removed from the socket. Additionally, the elastomeric shaft 150 is more easily retrieved because of its bright color.

FIG. 3 showing a second embodiment of the present invention, this figure showing a second embodiment of a ground stake 202. This embodiment having the same general features as the embodiment of FIGS. 1-2 (i.e., abutment collar (top flange) 215, pointed distal end (tip) 220, connection body 210, internal passageway ("socket cavity") 230, internal passageway open end 216, planar surface 212, internal passageway closed end 214, ground engaging portion 236, retaining ridges 260). Of note in this embodiment is that the retaining ridges 260 are a screw threading style (for allowing the shaft to be screwed therein vs. the concentric flanges 160 shown in FIGS. 1-2 for grasping the shaft. Further, in this embodiment the exterior surface is smooth and does not have the retaining ridges 140 shown in FIGS. 1-2.

Radio frequency identification (RFID) tags (98, 99) may be attached to the ground stake 102 and/or the marking post 104 to aid in locating these parts if they do get separated, and to store survey or other information. Additionally, a user could program information into the RFID tags while in the field or at a base location. This information could include any information relating to the survey point, name and individual assigned to the project, contact information, etc.

The invented marking stake 100 can be used for many different applications and in many different manners. In one example installation, once a user has found a specific location that he needs to mark, he selects a color of his choice. He then drives the flanged socket into the ground at the desired location. The manner the flanged socket is driven into the ground will depend on the soil type and user preference. The socket is preferably driven into the ground until the flange is flush with the ground. At this point, or later, the user may elect to write survey, location, or other information/data on the flange of the socket.

The user then selects a marking post. At this point, or later, the user may elect to write survey, location and/or other information/data upon the paddle (planar writing surface) of the marking post. The user would then decide what he would like the shaft extraction force to be. The farther the user twists the elastomeric shaft into the shaft cavity and corresponding buttress screw thread the greater the shaft extraction force will be. The user will likely elect to choose an extraction force that is less than the socket extraction force so that if an animal were to pull on the shaft, it would come free before the socket would come free from the ground. However, a user could make the shaft extraction force anything he chooses. When a user needs to remove the elastomeric shaft from the socket, he will simply twist it in the opposite direction to remove it from the socket.

Once a user has connected the socket and the elastomeric shaft, he may return at anytime to gather more information or alter or move the marking stake as needed. In some cases, animals may have tugged the elastomeric shaft from the socket. In that instance, a user may visually scan the general location to find the fluorescent shaft and flange wherever they may be. Sometimes the shaft and socket will not be readily visible because of plants, weeds, dirt, rocks and other visual obstructions. In those instances, the user can use the RFID tags to find the parts of the marking stake. Additionally, at any point during the marking process, the RFIDs of the shaft and socket can be programmed with information or used to gather the preprogrammed information as needed.

The present invention may further include an admixture treatment on at least a portion of the exterior surface of the ground stake/socket for increasing the holding power of the stake in the ground. This would be very similar to cement coated nails, where the coating "melts" under the influence of friction during insertion and "glues" the nail into the wood. A ground stake with an admixture coating would function similarly with the coating "gluing" the stake within the soil. To apply a coating to the stake, it (preferably the ground engagement portion) would be dipped, sprayed, or brushed with a coating such as rosin, shellac, or a synthetic resin, for example, vinyl or acrylic. Other types of coatings are envisioned. When the stake is driven into the ground, the heat from friction softens the thin film of resin on the stake shaft, which then adheres to soil particles and significantly increases the extraction force of the stake.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A damage resistant marking stake comprising:

a socket for insertion into the ground in order to mark a location, said socket having a first end and a second end, wherein said socket first end comprises a driving tip for inserting said socket into the ground, and said second end comprises a flange for abutting a ground top surface, wherein said socket further defines a socket cavity with a plurality of regularly spaced retaining ridges defining a periphery of said socket cavity, wherein said regularly spaced retaining ridges are a buttress screw thread that allows twisting of an elastomeric shaft into said socket determining said shaft extraction force based on the distance, said shaft is screwed into said socket against said buttress screw thread; and said elastomeric shaft having a first end configured for insertion into said socket cavity of said socket, said elastomeric shaft having a smooth outer surface, the portion of said elastomeric shaft adjacent said first end comprising an elongated socket engaging portion, wherein when inserted into said socket, a plurality of said regularly spaced retaining ridges engage said smooth outer surface at various points along said socket engaging portion of said elastomeric shaft to prevent said elastomeric shaft from being easily removed from said socket and wherein a user can select a desired shaft extraction force based on the insertion depth of said elastomeric shaft in said socket cavity and the resulting number of ridges that engage said smooth outer surface, and wherein said shaft extraction force is less than a socket extraction force that would be required to extract said socket from the ground.

2. The damage resistant marking stake of claim 1, further comprising, slits defined within said socket and interconnecting with said socket cavity for allowing said elastomeric shaft to be inserted into said socket without creating a rebounding force from compressed air that would prevent or make difficult the insertion of said elastomeric shaft into said socket.

3. The damage resistant marking stake of claim 1, further comprising a plurality of ground retaining ridges defined by an external surface of said socket for preventing said socket from being easily removed from the ground.

4. The damage resistant marking stake of claim 1, further comprising a paddle extending from a second end of said elastomeric shaft for more visibly marking said location and for allowing information to be written or displayed thereon.

5. The damage resistant marking stake of claim 1, wherein information can be written or displayed upon said flange.

6. The damage resistant marking stake of claim 1, wherein said socket extraction force is greater than said shaft extraction force so that if said elastomeric shaft is removed from said socket, said socket will remain in the ground, still marking said location.

7. The damage resistant marking stake of claim 1, wherein said socket cavity is tapered allowing said elastomeric shaft to fit more tightly within as it is inserted further.

8. The damage resistant marking stake of claim 1, wherein said elastomeric shaft is tapered.

9. The damage resistant marking stake of claim 1, wherein said socket cavity and said elastomeric shaft further comprise RFID tags.

10. A method of using a damage resistant marking stake comprising:

driving a flanged socket into the ground to mark a specific location, said flanged socket having a driving tip at a first end for ground insertion and a flange at a second end for abutting a ground top surface; and twisting an elastomeric shaft having a smooth outer surface into a cavity defined within said flanged socket wherein an inner periphery of said cavity defines a tapered buttress screw thread which engages said smooth outer surface of said elastomeric shaft at various points along said elastomeric shaft, wherein the desired extraction force required to remove said elastomeric shaft from said flanged socket is selected by said twisting and a depth said elastomeric shaft is twisted into said flanged socket.

11. The method of using a damage resistant marking stake of claim 10, further comprising writing survey information on at least one of the flange end of said flanged socket and a paddle extending from said elastomeric shaft.

12. The method of using a damage resistant marking stake of claim 10, further comprising programming information into an RFID tag within at least one of said flanged socket and said elastomeric shaft.

* * * * *

UNITED STATES PATENT AND TRADEMARK OFFICE

CERTIFICATE OF CORRECTION

PATENT NO. : 7,631,447 B2
APPLICATION NO. : 11/157682
DATED : December 15, 2009
INVENTOR(S) : Morton et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 796 days.

Signed and Sealed this

Second Day of November, 2010

David J. Kappos

David J. Kappos
*Director of the United States Patent and Trademark Office*